United States Patent [19]

Lundblad

[11] 4,283,097

[45] Aug. 11, 1981

[54] CASSETTE FOR HANDLING BANKNOTES OR THE LIKE

[76] Inventor: Leif Lundblad, Häradsvägen 102, S-141 41 Huddinge, Sweden

[21] Appl. No.: 21,696

[22] Filed: Mar. 19, 1979

[30] Foreign Application Priority Data

Mar. 21, 1978 [SE] Sweden ..... 7803222

[51] Int. Cl.[3] ..... G07F 9/06

[52] U.S. Cl. ..... 312/223; 271/145; 340/149 R; 340/543; 312/271; 312/294; 232/1 R

[58] Field of Search ..... 194/4 R; 221/6, 154, 221/197; 340/149 X, 543 X; 206/86; 312/215, 223, 271, 294, 1 R, 295; 232/15, 16; 109/18 R; 271/145 X

[56] References Cited

U.S. PATENT DOCUMENTS

| | | | |
|---|---|---|---|
| 3,720,408 | 3/1973 | Horn | 271/18 R |
| 3,773,252 | 11/1973 | Jensen | 232/15 |
| 4,066,253 | 1/1978 | Lundblad et al. | 194/4 R |
| 4,133,419 | 1/1979 | Greenwald et al. | 232/15 |

*Primary Examiner*—Casmir A. Nunberg
*Attorney, Agent, or Firm*—Kinzer, Plyer, Dorn & McEachran

[57] ABSTRACT

A cassette for banknotes and like valuable articles is provided with a displaceable lid (6) and locking means (10) for latching the lid of the cassette when the cassette is located outside a housing (25) in which it is intended to be placed. An operating means (8) is arranged to co-act with the locking means and with a latching element (15). The latching element is arranged to be released in dependence upon a pre-set program. A signal circuit is arranged to send a code signal to a detector circuit (23) when electrical contact elements on the cassette and the housing co-act with one another, which detector circuit, when the signal coincides with the signal program in the detector circuit, causes a signal to be sent for moving the latching means to a non-latching position.

4 Claims, 3 Drawing Figures

CASSETTE FOR HANDLING BANKNOTES OR THE LIKE

The present invention relates to a cassette having four side walls, a bottom and an open upper side for handling banknotes or the like, said cassette being arranged to be mounted in a housing and being provided with a displaceable lid arranged to cover said open side of said cassette, a locking means arranged to hold the lid locked when the cassette is removed from the housing; an operating element to co-operate with said locking means and also with a latching means, said latching means being arranged to be released in dependence upon a pre-determined program when an electric contact means on the cassette co-acts with an electric contact means on the housing, and to permit the operating element to be pre-set when said latching means is released.

Such cassettes are used, for example, in banknote dispensing apparatus of the type illustrated and described in U.S. Pat. No. 4 066 253, but can also be used in other connections such as for storing banknotes, or other types of valuable papers, such as cheques etc.

The primary object of the present invention is to provide a cassette which when it is located outside the housing is automatically locked and which can not be opened with a key or like device. The cassette is unlocked by inserting the same into the housing in a manner such that said cassette receives a code signal arranged to release internal latching means, whereby the lid can be displaced from the open side in a manner to enable banknotes or the like to be placed into or removed from said cassette.

This, and other objects, is realized by providing a signal circuit which, when the aforementioned electrical contact means co-act a code signal is sent to a detecting circuit which, provided the signal coincides with the programmed signal in the detecting circuit, causes an opening signal to be sent for moving the latching means to a non-latching position.

Figure 1:
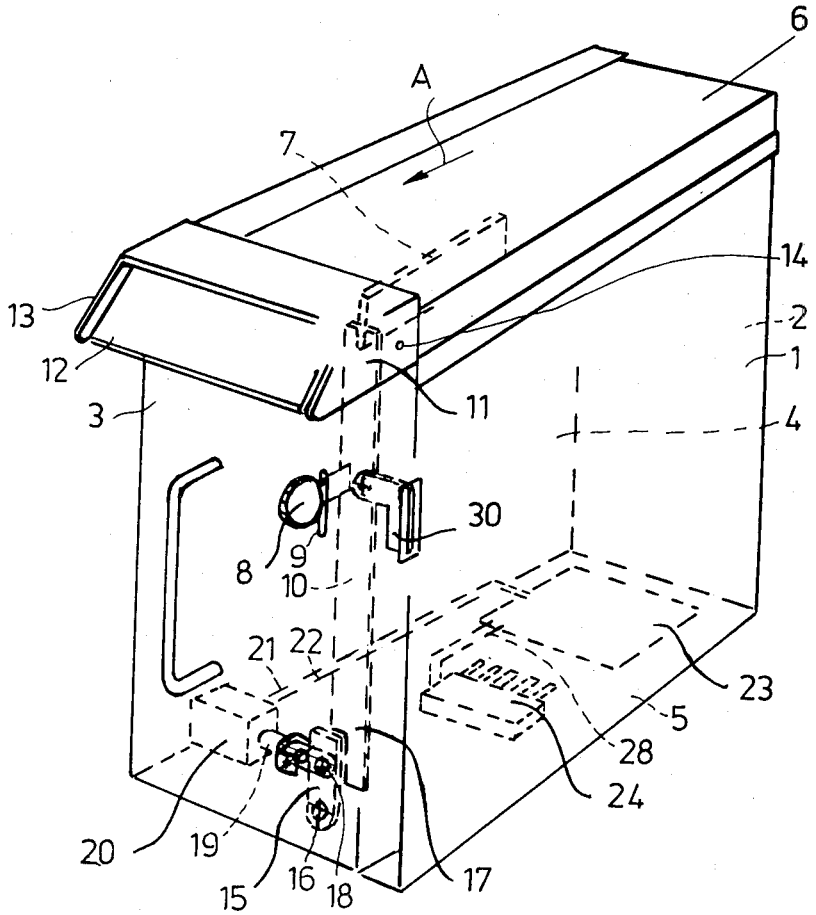
Figure 2:
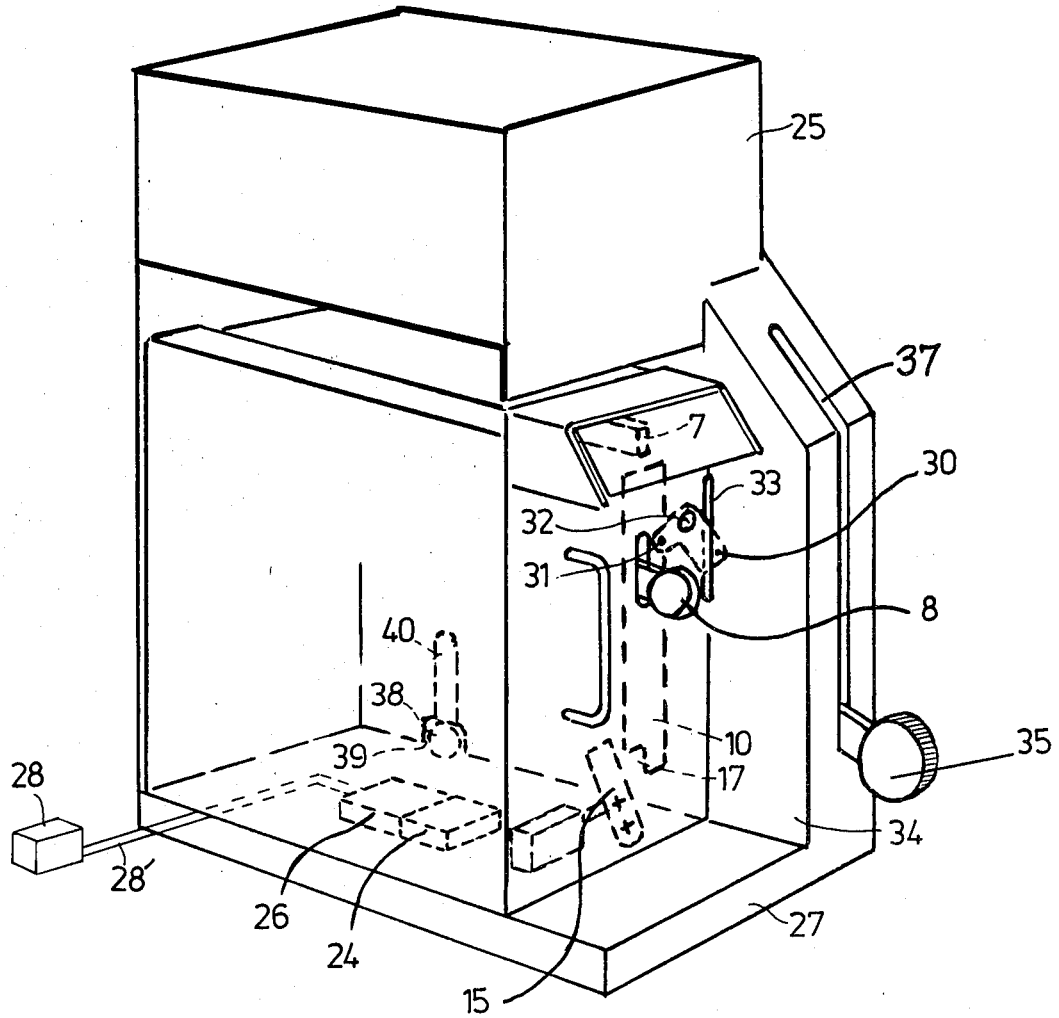
Figure 3:
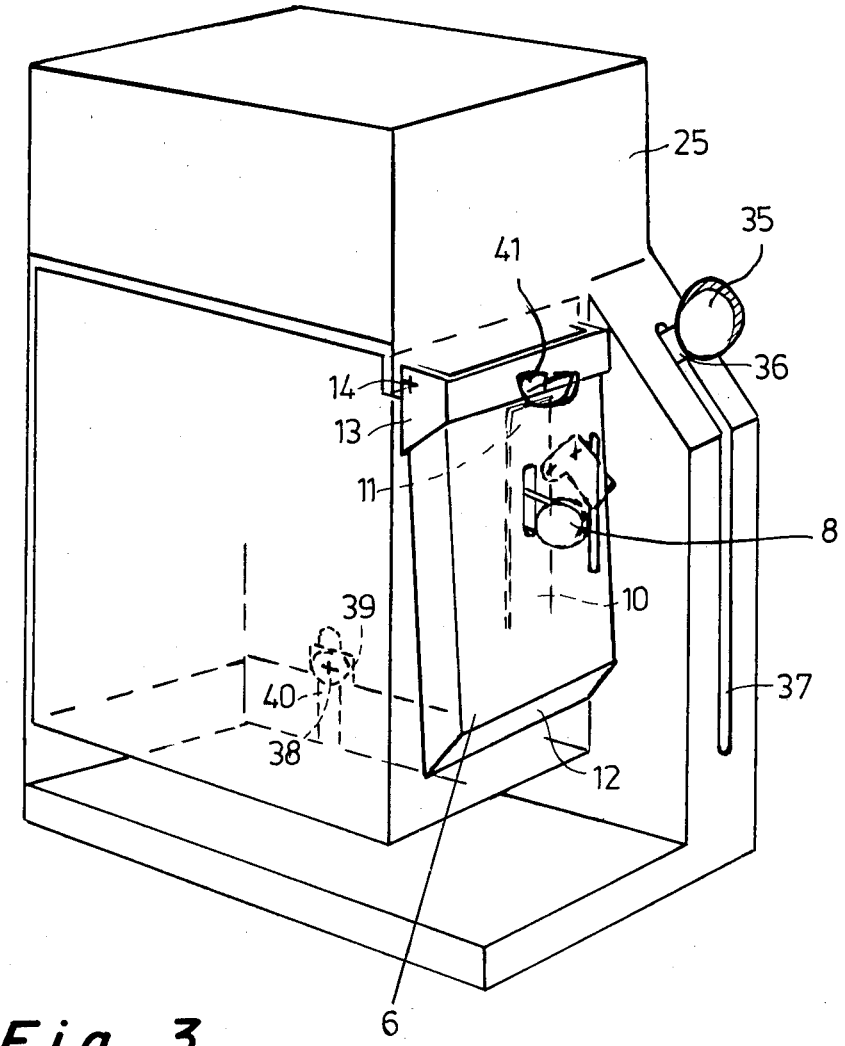

So that the invention will be more readily understood and optional features thereof made apparent, an exemplary embodiment of the invention will now be described with reference to the accompanying schematic drawings, in which FIG. 1 illustrates a cassette constructed in accordance with the invention located outside the housing into which it shall be inserted, FIG. 2 illustrates the cassette placed in said housing with the lid of the cassette unlocked and FIG. 3 illustrates an open cassette arranged in said housing.

As will be seen from FIG. 1, the cassette comprises an elongate, rectangular box have four side walls 1,2,3,4, a bottom 5 and an upper, open side which can be closed by means of a lid 6. The lid 6 is displaceable in the direction of the arrow A, there being arranged between the lid and the side walls 1 and 4 rails or like guide means not shown. Arranged on the inner surface of the lid 6 is a downwardly extending latching bar 7. An upper latching part 11 of an upwardly and downwardly movable latching element 10 in the form of a flat bar is arranged to lie in front of the end of the latching bar 7, said latching element 10 being movable by means of a handle 8 which projects out through a vertical slot 9 on the front wall 3 of the cassette. Thus, in the position shown in FIG. 1, the lid 6 cannot be moved in the direction of the arrow A, and a rearward latching means (not shown) in the form of a shoulder on the inner surface of the lid 6 co-acts with the upper edge part of the wall 2 of the cassette. Thus, the lid 6 cannot be moved further rearwardly. The lid 6 has a forward grip 12, which can be reached between a collapsable protective device 13, which is pivotally arranged on a horizontal shaft 14. When occupying its upper position, in which it latches the lid, the latching bar 10 is held by means of a latch 15 which is pivotally mounted on a shaft 16. The latch 15 engages a recess 17 in the bar 10, thus preventing the bar from being moved downwardly when the grip 8 is activated. The latch 15 is pivotally connected above the shaft 16, via a shaft 18, to a reciprocatingly movable armature 19 on an electric magnet 20. The winding of the electric magnet 20 is connected to a detector circuit 23 via two conductors 21,22. The detector circuit 23 contains components such as a shift register, arranged to detect the type of the incoming signal which code signal shall be adapted to a program or a pattern of signals determined by the various components of the detector circuit.

Arranged on the bottom 5 of the cassette is an electrical contact means 24 arranged to co-act with an electrical contact means 26 in the bottom 27 of the housing 25 when the cassette is inserted into said housing (FIG. 2).

When the two electrical contact means 24,26 co-act, in a manner shown in FIG. 2, a signal circuit 28' to the detector will be closed and the detector circuit 23 will be connected to a further signal emitter 28. The emitter 28 sends a code signal, which may be characteristic of the cassette used, of a group of cassettes, or of a customer, for example a departmental store, having a large number of cassettes. The code signal sent by the signal emitter 28, is received and deciphered by or detected in the detector circuit and if the program therein corresponds to the code signal, there is sent an opening signal over the conductors 21,22 (FIG. 1); The signal emitter 28 may comprise a micro processor arranged to deliver and collect information from the cassette, or in the simpliest case may comprise a voltage source arranged to deliver a code signal in pulse form to the detector circuit 23. The relay 20 is magnetized hereby and withdraws its armature 19 whereupon the latch 15 is swung out of engagement with the bar 10. The bar 10 can now be moved downwardly by means of the handle 8, in a manner to allow the latching bar 7 to slide over the upper end of the latching bar 10. As shown in FIG. 2, an angle arm 30 is pivotally mounted on the latching bar 10. One arm of the double-arm element 30 is pivotally connected to the bar 10 by means of a pivot 31 and is pivotally connected to the forward side wall 3 of the cassette by means of a further pivot 32. When the latching bar 10 is moved downwardly, the double-arm element 30 will be swung counter-clockwise and one arm thereof will slide into a groove 33 arranged in the inner wall 34 of the housing 25. The opposite side wall of the housing facing the side wall 4 of the cassette has not been shown in the drawing. The lid of the cassette can thus be drawn out and the upper opening of the cassette exposed to permit access to any valuable papers, such as banknotes in the cassette by means of a dispensing mechanism or the like arranged in the upper part of the housing.

FIG. 3 illustrates further elements of the cassette and housing combination, and also shows the cassette in its working position. The housing is provided with a lever mechanism having a handle 35. The handle 35 is connected to a lever 36, only part of which is illustrated. The lever 36 is arranged to move in a slot 37 arranged in the right wall of the housing 25 as seen in the figure. The lever mechanism is provided with a lifting peg 38 which can be displaced vertically in a groove 20 in the right-hand wall of the housing 25. When the cassette is moved into the housing to the position illustrated in FIG. 2, the lifting peg 38 will lie opposite a recess or aperture 39 in the lower edge of the side wall 1 on the cassette. When the handle 35 is then moved upwardly from the position shown in FIG. 2 to the position shown in FIG. 3, the lifting peg 38 will be first moved into the recess 39 by means not shown and will then move upwardly in the groove 40 to lift the cassette up to the working position, in which the signal emitter 28 is disconnected from the cassette.

FIG. 3 illustrates the lid 6 in its pull-out and collapsed position, in which position the rear edge of the lid is held by the depressed protective device 13. As indicated in FIG. 3 the lid 6 is provided on its inner surface and on its rear part a latching cam 41 which, when the lid is drawn out, lies over and against the upper edge of the latching bar 10. The latching cam 41 is approximately semi-circular in shape and is arranged to abut the latching bar both in the drawn-out, horizontal position of the lid 6, and in the downwardly swung position of the lid shown in FIG. 3. Consequently, it is not possible to move the latching bar 10 upwardly such as to release the cassette from the housing, once the lid has been drawn out.

When removing the cassette from the housing, the aforedescribed steps are carried in reverse order and the cassette is thus closed by means of the lid 6 when the cassette is removed. In order to place valuables in the cassette and thus open the lid, when the cassette is located outside the housing, there is used an associated signal-emitting device which permits the lid to be unlocked with the cassette located outside its housing.

As beforementioned the signal emitter 28 may comprises a micro processor arranged to control a multiplicity of cassettes forming part of a system for, for example post offices, banks, departmental stores etc. Conveniently communication between the micro processor and the cassettes is two-directional and consequently the detector circuit required for detecting a code signal sent by the micro processor, which code signal may comprise a pulse train, is arranged to re-send information to the micro processor. This information may comprise the number of the cassette, the value of the banknotes therein, the number of banknotes present in the cassette etc.

Another possible modification is one in which the cassette is provided with a drive means which is controlled by a latch and which is arranged to prevent the cassette from being removed from its housing subsequent to the latch having been moved to a non-latching position, by activating a second latch, and to enable the lid of the cassette to be opened when the cassette is located in the housing, by passivating a third latch.

In the aforegoing it has been indicated that certain parts of the cassette and housing co-act with one another. This co-action may include the sensing of the position of the cassette by means of built-in photo-cell devices and to send a start signal to the micro processor when the cassette occupies its correct position, said micro processor sending the signal for moving a latch to a non-latching position as a result thereof. A less complicated solution is to provide the cassette with a mechanical lock for locking the same, the arrangement being such that the lock cannot be released until said parts of said cassette and said housing co-act with one another, thereby causing a latch to be moved to a non-latching position. The construction in other respects is the same as that earlier described.

I claim:

1. A cassette has four side walls (1–4), a bottom (5) and an upper, open side through which banknotes or other valuables can be placed into and removed from said cassette, said cassette being arranged to be placed in a housing (25) and being provided with a displaceable lid (6) arranged to close the said open side of said cassette, a locking means (10) arranged when the cassette is removed from the housing to hold the lid locked; an operating element (8) arranged to co-act with the locking means (10) and with a latching means (15), said latching means being arranged to be released in dependence upon a pre-set program when an electrical contact means (24) on the cassette co-acts with an electrical contact means (26) on the housing and when released permits the resetting of the operating means, characterized in that a signal circuit (28) is arranged to send a code signal to a detector circuit (23) when said electrical contact means (24, 26) co-act with each other whereby, when said signal coincides with the signal program in the detector circuit there is sent an opening signal for moving the latching means (15) to a non-latching position and when the cassette is located in the housing, the locking means (10) is arranged, subsequent to the latch (15) having been moved to a non-latching position, to simultaneously enable removal of the cassette from the housing to be prevented and to enable the lid (6) of the cassette to be opened to provide access to the contents of the cassette from outside the housing, and in that the lid (6) of the cassette is arranged, in its open position, to prevent said operating element (8) from being manipulated and thereby prevent removal of the cassette from the housing.

2. An arrangement as claimed in claim 1, characterized in that said latch (15) comprises or is activated by an armature (19) of a relay (20) whose coil is arranged to receive said signal subsequent to detection in said detector circuit; and in that a further latch (30) is arranged to project into the housing when the operating means (10) is moved from its starting position to its working position, thereby to prevent removal of the cassette from the housing.

3. An arrangement as claimed in claim 1, characterized in that said co-action between said electrical contact means (24,26) of the cassette and the housing respectively comprises sensing deposition of the cassette by means of built-in photo cell devices and, when the cassette is located in its correct position to send a starting signal to a micro processor controlling said arrangement, said micro processor being arranged herewith to send said signal.

4. An arrangement as claimed in claim 1, characterized in that the electrical circuit arranged in said cassette for detecting said signal comprises means for emitting to the micro processor a signal containing information regarding the cassette and/or its contents.

* * * * *